United States Patent [19]

Martin et al.

[11] 4,337,635

[45] Jul. 6, 1982

[54] COMPRESSION TOOL

[75] Inventors: William C. Martin; Stephen V. Hoydic, Jr., both of Fairview, Pa.

[73] Assignee: Teledyne Penn-Union, Edinboro, Pa.

[21] Appl. No.: 165,774

[22] Filed: Jul. 3, 1980

[51] Int. Cl.[3] ..... B21D 7/06; B21D 37/10

[52] U.S. Cl. ..... 72/410; 72/416; 72/453.16

[58] Field of Search ..... 72/410, 409, 416, 453.16, 72/453.15; 29/282

[56] References Cited

U.S. PATENT DOCUMENTS

| | | | |
|---|---|---|---|
| 3,175,281 | 3/1965 | Elfsten | 72/410 |
| 3,326,029 | 6/1967 | Porter | 72/410 |
| 3,396,571 | 8/1968 | Porter | 72/410 |
| 3,553,999 | 1/1971 | Rommel | 72/410 |
| 3,732,718 | 5/1973 | Barberio | 72/410 |
| 3,769,704 | 11/1973 | Abarotin | 72/416 |
| 3,791,189 | 2/1974 | Lawson | 72/410 |

OTHER PUBLICATIONS

Anderson, "Compression Tools and Accessories", p. 2, Section D-1, Apr. 1978.

*Primary Examiner*—Gene Crosby

*Attorney, Agent, or Firm*—Trexler, Bushnell & Wolters, Ltd.

[57] ABSTRACT

A compression tool for compressing a generally tubular workpiece, comprises a tool head having an open, workpiece-receiving end. A plurality of generally parallel, spaced apart movable compressing members are carried by the tool head. A stationary compression surface also carried by the tool head opposingly faces the movable compressing members. Guides are provided in the tool head for slidably mounting the movable compressing members. A ram drives the movable compressing members towards their respective maximum compressed positions, which are defined by the ram and a ram-carrying channel. This maximum compressed position generally increases in a predetermined sequence from the workpiece-receiving end of the tool head toward an interior portion of the tool head.

22 Claims, 11 Drawing Figures

Fig. 1.
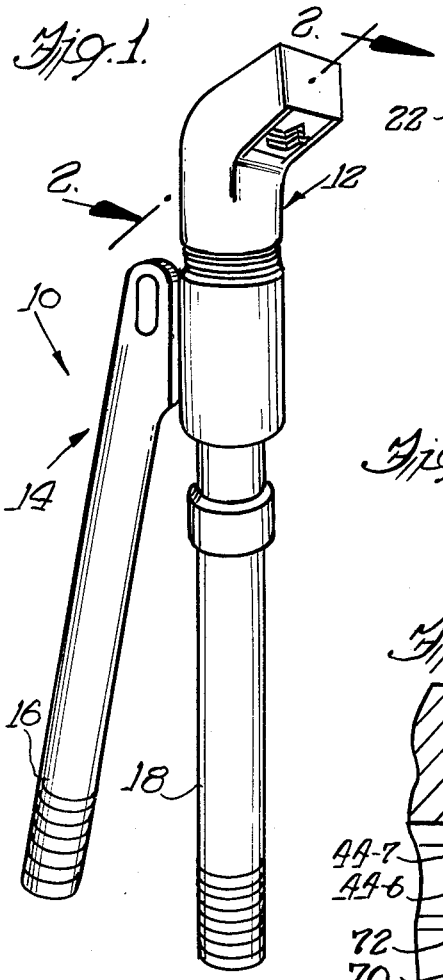
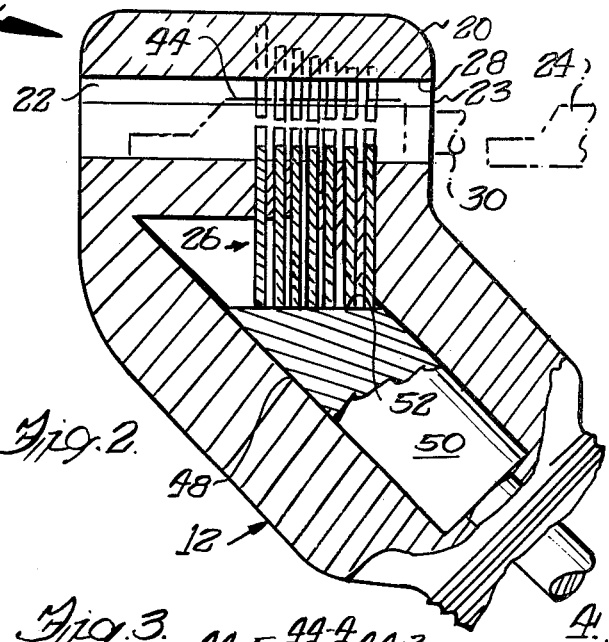
Fig. 2.
Fig. 3.
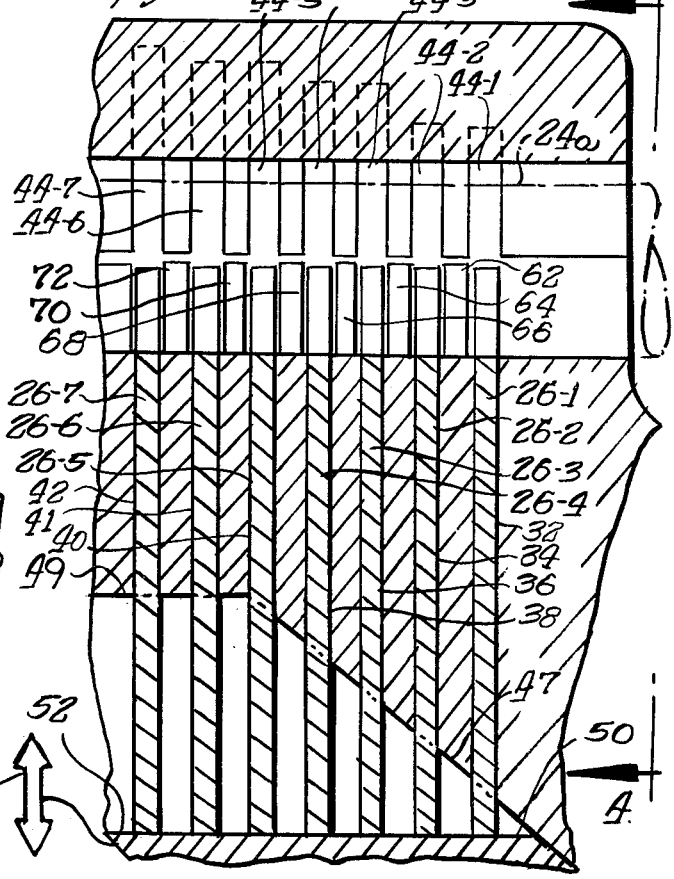
Fig. 5.
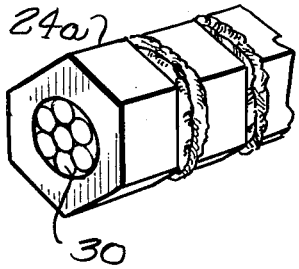

COMPRESSION TOOL

BACKGROUND OF THE INVENTION

This invention is directed generally to the field of compression tools and more particularly to a compression tool for compressing or crimping generally tubular workpieces such as connectors or terminals utilized for establishing electrical wiring connections.

A number of compression tools have heretofore been proposed for compressing or crimping the generally tubular terminal or connector members of the type utilized in electrical wiring installations. Briefly, these tubular connectors receive a wire or bundles of wire and must be crimped or compressed in order to securely form both a mechnical and electrical union between the connector or terminal and the wire.

The wire sizes and corresponding connector or terminal sizes vary over a considerable range for achieving different wire gauge connections. For example, the outer diameters to be compressed or crimped may range from as small as $\frac{1}{4}''$ to as large as 2".

Generally speaking, the crimping or compressing tools heretofore proposed for accommodating this range of sizes of connectors or terminals have been of two basic types: (1) a tool having a tool head provided with an interchangeable set of removable diesets, one dieset for each connector size or for sizes within given limited ranges; and (2) a tool having a tool head which carries a single, permanent crimping or compression member which is compressable to different degrees or extents in order to accommodate a given range of sizes.

The former type of tool can be rather difficult and time-consuming to use, as the removable, interchangeable diesets must be frequently changed in the field, whenever different sized wires and the corresponding connectors or terminals are to be installed. The latter type of tool is generally referred to as a "dieless" compression tool. The term "dieless" refers to the single, permanent die or compressing structure which is utilized, rather than the multiple, interchangeable, removable diesets provided with the former type of tool. Tools of this latter type have heretofore proven relatively heavy and complex, and have been relatively difficult to operate. Moreover, many of these latter tools are prone to frequent malfunction due to the complexities of their design.

Additionally, the tools of the second type have generally provided an indentor-type of crimp, which is a crimp or compression centered about a single indentation, made by the tool, in the terminal or connector. However, a polygonal and preferably, a hexagonal configuration of compression or crimping is generally regarded as superior in achieving both electrical and mechanical union of such a connector or terminal with electrical wires.

OBJECTS AND SUMMARY OF THE INVENTION

Accordingly, it is an object of this invention to provide a novel and improved compression tool.

A more specific object is to provide a compression tool of the foregoing type which is capable of accommodating a relatively broad range of connector or terminal sizes.

A related object is to provide a compression tool of the foregoing type which provides a polygonal compression configuration to the connector or terminal compressed.

A further object is to provide a compression tool of the foregoing type which is relatively simple in its design and operation and yet is highly reliable in operation.

Briefly and in accordance with the foregoing objects, a compression tool according to the present invention comprises a tool head having a through opening, a plurality of movable compressing members carried by said tool head, a stationary compression surface carried by said tool head and opposingly facing said plurality of movable compressing members, means carried in said tool head for defining a maximum compressing position for each of said plurality of compressing members, said maximum compressing positions generally increasing in a predetermined sequence from one end of said tool head through opening toward the other end of said tool head through opening and ram means for driving said plurality of compressing members towards their respective maximum compressing positions.

BRIEF DESCRIPTION OF THE DRAWINGS

Other objects, features and advantages of the invention will become more readily apparent upon reading the following detailed description of the illustrated embodiment together with reference to the accompanying drawings wherein:

FIG. 1 is an elevational view of a compression tool in accordance with the present invention;

FIG. 2 is an enlarged view, partially in section and partially broken away, of a head portion of the tool of FIG. 1 and taken generally along the line 2—2 thereof;

FIG. 3 is an enlarged view, partially in section, of a portion of FIG. 2;

FIG. 5 is a perspective view of a broken away portion of a typical connector or terminal, compressed by the novel tool of the present invention;

DETAILED DESCRIPTION OF THE ILLUSTRATED EMBODIMENT

Figure 4:
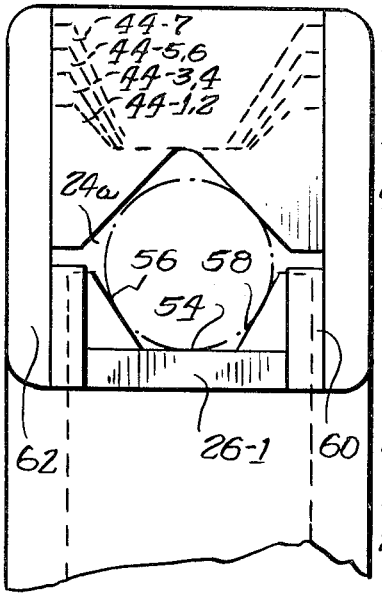
FIG. 4 is an enlarged view of a head portion of the tool of FIG. 3, taken generally along the line 4—4 thereof.

Referring now to the drawings and initially to FIG. 1, a compression tool in accordance with the present invention is designated generally by the reference number 10. This compression tool 10 includes a tool head designated generally by the reference numeral 12 and a manually controlled tool actuating portion designated generally by the reference numeral 14. This latter manual actuating portion 14 comprises a pair of handles 16, 18, the handle 16 being movable relative to the stationary handle 18 which is rigidly coupled with the tool head 12. The interior portion of handle 18 carries conventional hydraulic apparatus (not shown) which forms no part of the invention. Suffice it to say that this hydraulic apparatus is arranged for actuating the compression mechanism of the tool carried in the tool head 12.

Reference is next invited to FIG. 2, wherein the tool head 12, which carries the apparatus of the invention, is shown in additional detail. This tool head 12 generally comprises a housing 20 having a through aperture 22 for receiving at an open end 23 thereof a connector or terminal 24 (shown in phantom line) which is to be crimped or compressed.

In accordance with a feature of the invention the head 12 carries a plurality of generally parallel, spaced apart movable compressing members or dies, designated collectively by the reference numeral 26. These parallel dies 26 are generally perpendicular to the axis of the through aperture 22. Advantageously, these compressing members or dies 26 are permanently mounted in the head 12, and as will be more fully explained hereinbelow, are arranged for compressing or crimping terminals or connectors 24 over a relatively broad range of sizes. This novel arrangement avoids the necessity of providing a plurality of interchangeable, removable sets of dies as in many heretofore known compression tools.

The tool head 12 also carries a stationary compression surface 28 which opposingly faces the movable compressing members or dies 26. In operation, these movable compressing members 26 cooperate with the stationary compression surface 28 to impart the desired compression or crimping configuration to terminals or connectors such as the terminal 24. This compression achieves a mechanical and electrical connection of the terminal or connector 24 to wire conductors such as a wire bundle 30, indicated in phantom line.

Figure 6:
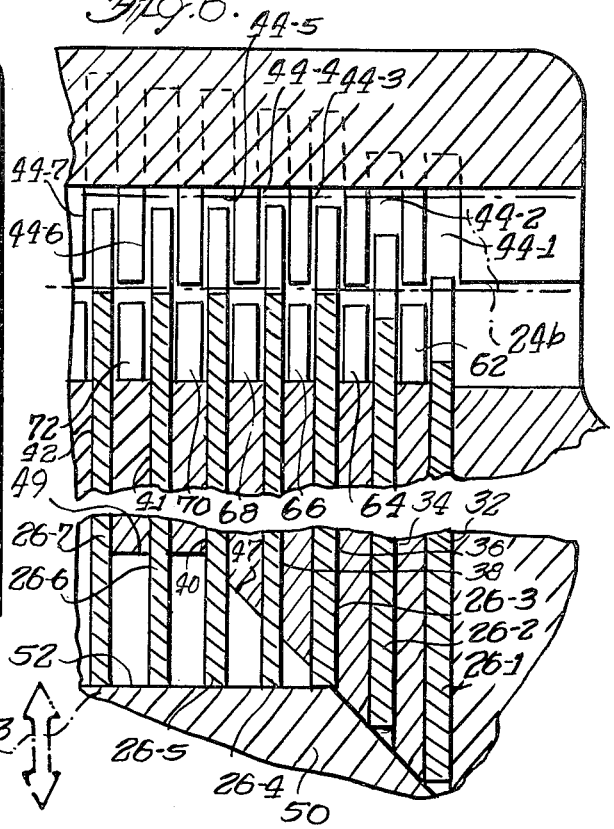
FIG. 6 is an enlarged sectional view, similar to FIG. 3, of a portion of the tool head of FIG. 2.

As viewed in FIGS. 3 and 6, the movable compressing members or dies are carried in a plurality of guide channels 32, 34, 36, 38, 40, 41 and 42. In the illustrated embodiment, seven of these movable compressing members or dies 26 are consecutively indicated by the reference characters 26-1 through 26-7, inclusive. Cooperatively, these movable compressing members or dies 26-1 through 26-7, inclusive are mounted for slidable movement within the respective guide channels 32 through 42, inclusive.

In accordance with a further feature of the invention, a novel arrangement is provided for defining a maximum compressed position for each of the movable compressing members or dies 26. Clearance is provided for the advancing dies 26 by a plurality of slots or indentations, indicated in FIG. 2 collectively by the reference numeral 44, and formed in the stationary compression surface 28. As viewed in FIGS. 3, 4 and 6, these slots or indentations 44 are consecutively indicated by reference characters 44-1 through 44-7, corresponding respectively to the dies 26-1 through 26-7. Advantageously, these indentations or slots 44 are of successively greater extent or depth with respect to the surface 28, thereby defining successively increased clearances during compression for their corresponding, opposed movable compressing members or dies 26.

Cooperatively, the tool head 12 carries a channel 48 which slidably mounts a ram 50. In accordance with a further feature of the invention, the channel 48, and particularly a sidewall surface 47 thereof, is formed at an angle or on a bias with respect to the parallel compressing members 26 such that a progressive offset of the ram 50 with respect to the dies 26 is experienced as it advances in the channel 48. Advantageously, the ram 50 is further formed with a die-engaging surface 52 which is formed at a further angle with respect to the channel 48. This latter angle of the die-engaging surface 52 is such that it is substantially perpendicular to the movable compressing members or dies 26 throughout the range of travel of ram 50 within the channel 48. The channel 48 has an upper stop surface 49 defining maximum advancement of the ram 50.

Moreover, this stop surface 49 and the sidewall surface 47 define the effective maximum advancement of the ram 50 with respect to the dies 26 and hence the maximum compression of the dies 26. Thus, this maximum compression of the dies 26 becomes progressively greater for successive dies 26-1, 26-2, etc., as viewed from right to left in FIGS. 2, 3 and 6. This ram 50 is actuated by means of a shaft 51, which is responsive to the hydraulic drive (not shown) carried in the handle 18, upon manual actuation of the handle 16, as discussed above.

Advantageously, as the ram 50 advances in the direction generally indicated by arrow 53, the increasing offset of the die-engaging surface 52 thereof will result in compression of progressively fewer of the movable compressing members or dies 26, as viewed from right to left in FIGS. 2, 3 and 6. Accordingly, progressively fewer of the movable compressing members or dies 26 are retained in compression as the ram 50 advances the dies 26 upon successively smaller terminals or connectors. Conversely, as terminals or connectors of greater diameter or size are introduced into the channel 22, a greater number of the compressing members or dies 26 remain activated by the ram 50. Consequently, the novel structure of the ram 50 and its channel 48 defines progressively increasing degrees or extents of maximum compression for the successive dies 26-1 through 26-7, as indicated by the arrows 55-1 and 55-6 in FIG. 2.

Reference is again invited to FIGS. 3 through 8, wherein further details of the novel structure of the compression tool are illustrated, and from which features of the operation thereof will be more readily appreciated. In FIG. 3 and FIG. 4 the tool head 12 is illustrated in operation, compressing or crimping a relatively large terminal or connector member **24*a* to achieve the compressed or crimped configuration thereof generally as illustrated in FIG. 5**.

As best viewed in FIG. 4, in accordance with a preferred form of the invention, the movable compressing members or dies 26 and stationary compression surface 28 cooperate to form a regular polygon, so as to impart substantially a regular polygonal appearance to the terminal or connector **24*a* (as best viewed in FIG. 5). Advantageously, this configuration of the movable compressing members or dies 26 and stationary compression surface 28 surroundingly engages the terminal or connector 24 so as to impart some degree of compression substantially continuously about the periphery thereof. Such continuous peripheral compression results in a reliable mechanical and electrical interconnection thereof with the wire bundle 30** carried therein.

Referring again to FIG. 4, each of the movable compressing members or dies 26 presents a substantially concave working or compression surface 54, defined by a pair of upstanding sidewalls 56, 58. In the illustrated embodiment, this concavity defines a pentagon. Cooperatively, the indentations or slots in the stationary compression surface 28 are formed with a complementary convex configuration to receive the concave compression surface 54 of the respective movable compressing members or dies 26-1, etc. However, the slots 44-1, 44-2, etc., have successively increasing depths at the lateral side portions thereof, which correspond generally to the upstanding sidewall portions 56, 58 of the movable compressing members or dies 26. These lateral side portions of the respective slots or indentations 44-1, 44-2, etc., thereby define successively increasing degrees or amounts of clearance for their respective cooperating movable compressing members or dies 26-1, 26-2, etc. Thus the progressively greater extents of compression imparted by the ram 50 are accommodated.

As best viewed in FIG. 4, the guide channels 32, 34, etc., are defined in the illustrated embodiment by means of a plurality of side-wall partition members 60, 62, which are interposed between respective movable compressing members or dies 26-1, 26-2, etc. Referring briefly to FIGS. 3 and 6, one of each of these pairs of partitions is seen, designated respectively by reference numerals 62, 64, 66, 68 and 72.

In operation, when compressing the relatively large terminal or connector 24*a*, as viewed in FIGS. 3 and 4, none of the movable compressing members or dies 26 reaches its maximum compressed position. Rather, each of these dies 26 advances within its respective guide channel 32, 34, etc., until the working surfaces e.g., 54, 56, 58 (with respect to die 26-1), come into contact with and compress the terminal or connector 24*a* so as to achieve the configuration thereof substantially as shown in FIG. 5.

Figure 7:
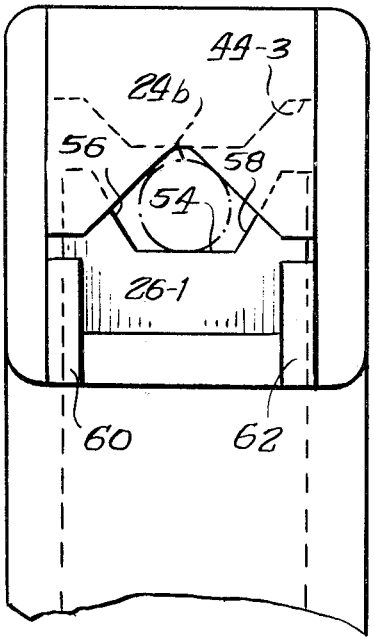
FIG. 7 is a view similar to FIG. 4.
Figure 8:
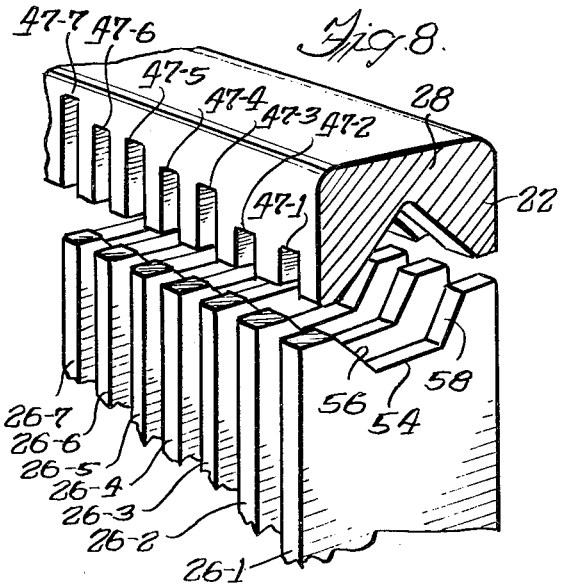
FIG. 8 is a perspective view of an interior portion of the tool head shown in FIGS. 3, 4, 6 and 7.

Referring now to FIGS. 6 and 7, a substantially smaller terminal or connector member 24*b* is illustrated under compression by the movable compressing members or dies 26-2 through 26-7, inclusive. In the case of this smaller terminal or connector 24*b*, it will be seen that the dies 26-1 and 26-2 have reached their maximum compressed positions as defined by the ram 50 and are no longer engaged by the surface 52 thereof and hence do not compress the workpiece 24*b*. However, the next succeeding dies 26-3 and 26-4 substantially reach their fully compressed positions as defined by the increased advancement of the ram 50 toward its stop surface 49 and impart the desired compression since these slots 44-3 and 44-4 are deeper than the slot 44-2. The die 26-4 in its cooperating receiving slot or indentation 44-4 are also illustrated in section in FIG. 7. The remaining dies 26-5 and 26-6 enter their respective indentations or slots 44-5 and 44-6 to some degree while compressing the workpiece 24*b*, but do not become fully advanced or compressed with respect to the slots 44-5 and 44-6.

As discussed above, in FIG. 6 the righthand-most dies 26-1 and 26-2, do not compress the terminal or connector 24*b*. Rather, it will be seen that the ram 50 has advanced to a degree where the surface 52 thereof is no longer in contact with the dies 26-1 or 26-2. In accordance with a heretofore mentioned preferred feature of the invention then, as smaller terminals or connectors such as the terminal or connector 24*b* are presented for compression, fewer of the movable compressing members or dies 26 actually engage and compress the terminal or connector.

Figure 9:
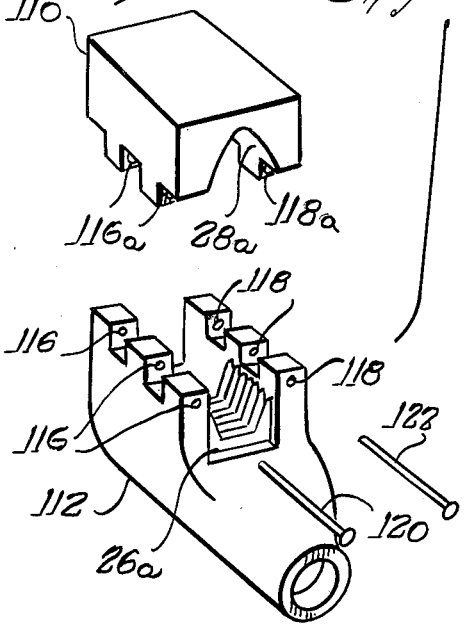
FIG. 9 is an exploded perspective view of a second embodiment of a head portion of the novel dieless compression tool of the invention.
Figure 10:
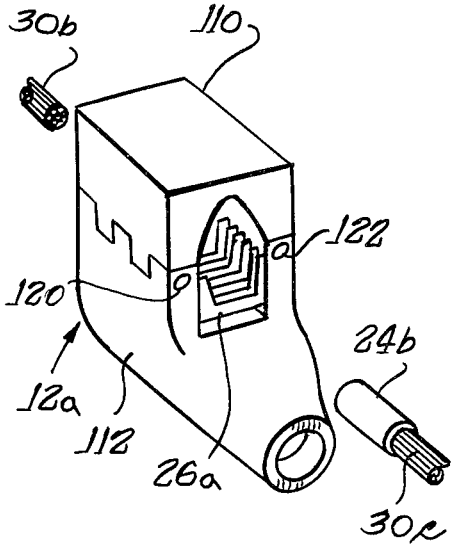
FIG. 10 is a perspective view of the assembled head portion of the compression tool of FIG. 9.
Figure 11:
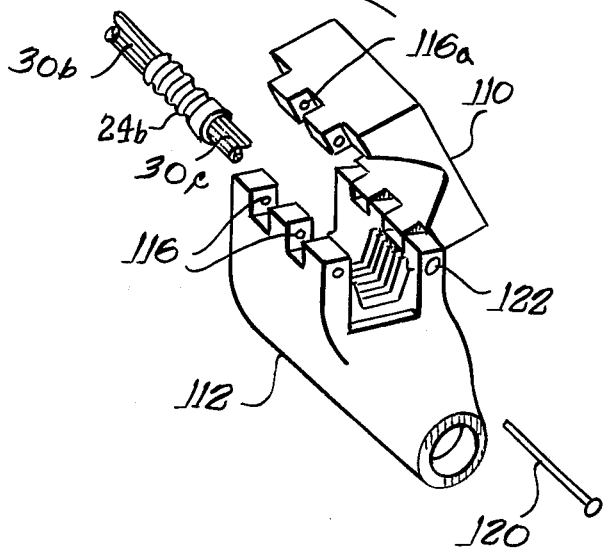
FIG. 11 is a perspective view, similar to FIG. 10, illustrating the operation of the tool head illustrated therein.

Reference is next invited to FIGS. 9, 10 and 11 wherein a second embodiment of the tool head 12 is generally designated by the reference numeral 12*a*. Advantageously, the tool head 12*a* is designed for the splicing or joining of a pair of wires or cables by means of a splicing connector 24*b*, as best seen in FIG. 10.

Referring initially to FIG. 9, the tool head 12 comprises an upper half or portion 110 and a lower half or portion 112. Briefly, in the upper half or portion 110 is carried a stationary compression surface, designated generally by the reference numeral 28*a*, which is substantially identical to the stationary compression surface 28 illustrated and described above with reference to the preceding FIGS. 1 through 8. Additionally, this compression surface 28*a* is formed with a plurality of slots or indentations (not seen in FIGS. 9–11) which are substantially identical to the slots or indentations 44, illustrated and described above with reference to FIGS. 1 through 8.

Similarly, the lower half or portion 112 of the tool head 12*a* is substantially identical in configuration to the lower half or portion of the tool head 12 as illustrated in FIGS. 1 through 8 above. In this regard, the portion 112 carries a plurality of slidably mounted dies 26*a*, mounted for reciprocation in response to movement of a ram (not shown) mounted at an offset or angle in a channel (not shown). These movable compressing members or dies 26*a* and the actuating ram and channel are all substantially identical to those illustrated and described above with reference to FIGS. 1 through 8.

Referring now to FIG. 9, it will be seen that the upper tool head half 110 has a castellated configuration on the opposing surface thereof and facing the lower tool head half 112. Similarly, the lower tool head half 112 has a complementary castellated configuration at its opposing side surfaces which face the upper tool head half 110. These castellated surfaces of the tool head halves 110, 112 advantageously interfit to define the assembled tool head 12*a*, as best viewed in FIGS. 10 and 11. Additionally, through apertures 116, 118 are provided in the raised portions of the castellated side walls of the lower tool head half 112 and similar through apertures 116*a*, 118*a* are provided in the castellated sidewalls of the upper tool head half 110. These through apertures 116 and 116*a* as well as the similar through apertures 118 and 118*a* are respectively in alignment when the upper tool head half 110 is assembled with the lower tool head half 112. A pair of pins 120, 122 are insertable through the respective aligned through apertures 116, 116*a* and 118, 118*a*.

Accordingly, as best viewed in FIGS. 10 and 11, one of the pins 120, 122 may be non-removably retained in its receiving apertures 116, 116*a* or 118, 118*a*, thereby effectively forming a hinged joint between the upper and lower tool head halves 110, 112. The other of the two pins 120, 122 may then be provided as a removable pin, to allow opening and closing of the tool head 12*a* about the connector 24*b* for facilitating splicing of a pair of wires 30*b*, 30*c* (see FIGS. 10 and 11). It will be appreciated that provision of the hinged tool head 12*a* , thus permits splicing of a pair of wires utilizing a splicing connector 24*b*, in addition to the attachment of a terminal 24 to a single wire or cable 30, as illustrated and described above in connection with FIGS. 1 through 8.

What has been described above is a novel and improved hydraulic, dieless compression tool. While a preferred form of the invention has been illustrated and described herein, the invention is not limited thereto. On the contrary, various changes, alternatives and modifications may become apparent to those skilled in the art upon reading the foregoing descriptions. Accordingly, the invention is intended to include such changes, alternatives and modifications insofar as they fall within the spirit and scope of the appended claims.

The invention is claimed as follows:

1. A compression tool for compressing a generally tubular workpiece, comprising: a tool head having a through opening, a plurality of generally parallel, spaced apart movable compressing members carried by said tool head, a stationary compression surface carried by said tool head and opposingly facing said plurality of movable compressing members, guide means carried by said tool head for slidably mounting said plurality of movable compressing members, means carried in said tool head defining a maximum compressing position for each of said plurality of compressing members, said maximum compressing positions generally increasing in a predetermined progression from one end of said tool head through opening toward an opposite end of said tool head through opening and ram means for driving said plurality of compressing members towards their respective maximum compressing positions.

2. Apparatus according to claim 1 wherein said tool head comprises means forming an enclosure having said through opening, said one end of said through opening defining a workpiece-receiving end.

3. Apparatus according to claim 1 wherein each of said movable compressing members includes a compression surface which defines, together with said stationary compression surface, a like polygonal aggregate compression surface for surroundingly engaging said workpiece.

4. Apparatus according to claim 3 wherein said polygonal aggregate compression surface defines a pentagon.

5. Apparatus according to claim 1 wherein said plurality of movable compressing members each comprises a substantially flat member having upstanding leading lateral edge portions defining a concave working surface.

6. Apparatus according to claim 5 further including a plurality of indentations, each of predetermined depth, formed in said stationary compression surface for receiving said leading lateral edge portions of each of said plurality of movable compressing members.

7. Apparatus according to claim 5 wherein said concave working surface defines substantially one-half of a regular polygon for engaging substantially one-half of the surface of said workpiece.

8. Apparatus according to claim 7 wherein said stationary compression surface substantially defines remaining sides of said regular polygon.

9. Apparatus according to claim 7 or claim 8 wherein said regular polygon comprises a pentagon.

10. Apparatus according to claim 1 wherein said ram means includes a compressing member-engaging surface and wherein said tool head further includes channel means at a predetermined angle with respect to said movable compressing members for carrying said ram means, said compressing member-engaging surface being substantially at a further predetermined angle with respect to said plurality of generally movable compressing members, said channel means and said compressing member-engaging surface and said predetermined angles thereof together providing said means defining said increasing predetermined progression of said maximum compressing positions of the movable compressing members.

11. Apparatus according to claim 10 further including a plurality of indentations formed in said stationary compression surface for receiving leading lateral edge portions of each of said plurality of movable compressing members, said indentations increasing in depth from the one end of said tool head through opening to the opposite end of said tool head through opening for defining similarly increasing clearances for said movable compressing members, thereby to accommodate said increasing maximum compressions thereof.

12. A compression tool for compressing a generally tubular workpiece, comprising: a tool head having an elongate workpiece-receiving opening, workpiece compressing means defining a plurality of spaced apart compression surfaces aligned with a predetermined portion of said workpiece-receiving opening, means carried in said tool head for defining a maximum compression by each compression surface of said compressing means, said maximum compression generally increasing in a predetermined fashion from one end of said compressing means toward an opposite end of said compressing means for compressing workpieces over a predetermined range of sizes in accordance with the extent to which the workpiece is inserted into said opening.

13. Apparatus according to claim 12 wherein said tool head comprises means forming an enclosure having a through opening defining said workpiece-receiving opening.

14. Apparatus according to claim 12 wherein said compressing means comprises a plurality of generally parallel movable compressing members, each including a compression surface, and an opposingly facing stationary compression surface, the respective compression surfaces collectively defining a polygonal aggregate compression surface for surroundingly engaging said workpiece.

15. Apparatus according to claim 12 wherein said polygonal aggregate compression surface defines a pentagon.

16. Apparatus according to claim 14 further including a plurality of indentations, each of predetermined depth, formed in said stationary compression surface for receiving leading edge portions of each of said plurality of movable compressing members.

17. Apparatus according to claim 14 wherein said plurality of movable compressing members each comprises a substantially flat member having upstanding leading lateral edge portions defining a concave working surface.

18. Apparatus according to claim 17 wherein said concave working surfaces defines substantially one-half of a regular polygon for engaging substantially one-half of the surface of said workpiece.

19. Apparatus according to claim 18 wherein said stationary compression surface substantially defines remaining sides of said regular polygon.

20. Apparatus according to claim 19 wherein said regular polygon comprises a pentagon.

21. Apparatus according to claim 14 further including ram means including a compressing member-engaging surface and wherein said tool head further includes channel means at a predetermined angle with respect to said movable compressing members for carrying said ram means, said compressing member-engaging surface being at a further predetermined angle with respect to said plurality of generally movable compressing members, said channel means and said compressing member-engaging surface and said predetermined angles thereof together providing said means defining said increasing maximum compressions by the movable compressing members.

22. A compression tool according to claim 1 or claim 12 wherein said tool head comprises an upper tool head half and a lower tool head half, said upper and lower tool head halves cooperating to define said workpiece-receiving opening and means hingedly joining said upper tool head half with said lower tool head half to facilitate insertion and removal of a workpiece.

* * * * *

UNITED STATES PATENT AND TRADEMARK OFFICE

CERTIFICATE OF CORRECTION

PATENT NO. : 4,337,635

DATED : July 6, 1982

INVENTOR(S) : WILLIAM C. MARTIN & STEPHEN V. HOYDIC, JR.

It is certified that error appears in the above-identified patent and that said Letters Patent are hereby corrected as shown below:

Column 8, line 29, "according to claim 12" should read --according to claim 14--;

Column 8, line 43, "surfaces" should be --surface--.

Signed and Sealed this

*Seventh* Day of *September 1982*

[SEAL]

*Attest:*

GERALD J. MOSSINGHOFF

*Attesting Officer*

*Commissioner of Patents and Trademarks*